United States Patent [19]

Barr et al.

[11] Patent Number: 4,697,654

[45] Date of Patent: Oct. 6, 1987

[54] ROTARY DRILL BITS

[75] Inventors: John D. Barr, Cheltenham, England; Malcolm R. Taylor, Houston, Tex.

[73] Assignee: NL Petroleum Products Limited, Gloucestershire, England

[21] Appl. No.: 754,570

[22] Filed: Jul. 12, 1985

[30] Foreign Application Priority Data

Jul. 19, 1984 [GB] United Kingdom ..... 8418482

[51] Int. Cl.[4] ..... E21B 10/46; E21B 10/60

[52] U.S. Cl. ..... 175/329; 175/400; 175/410; 175/418

[58] Field of Search ..... 175/329, 393, 409, 410, 175/418, 398, 400

[56] References Cited

U.S. PATENT DOCUMENTS

| | | | |
|---|---|---|---|
| 3,215,215 | 11/1965 | Kellner | 175/330 |
| 3,310,126 | 3/1967 | Gstalder et al. | 175/329 |
| 3,388,756 | 6/1968 | Varel et al. | 175/410 |
| 3,955,635 | 5/1976 | Skidmore | 175/400 |
| 4,246,977 | 1/1981 | Allen | 175/329 |
| 4,499,795 | 2/1985 | Radtke | 175/329 |
| 4,499,958 | 2/1985 | Radtke et al. | 175/329 |
| 4,538,691 | 9/1985 | Dennis | 175/393 |
| 4,577,706 | 3/1986 | Barr | 175/329 |

FOREIGN PATENT DOCUMENTS

| | | | |
|---|---|---|---|
| 2148978 | 6/1985 | United Kingdom | 175/339 |

*Primary Examiner*—Stephen J. Novosad
*Assistant Examiner*—Terry Lee Melius
*Attorney, Agent, or Firm*—Browning, Bushman, Zamecki & Anderson

[57] ABSTRACT

A rotary drill bit for use in drilling deep holes in subsurface formations comprises a bit body having a leading face and a gauge region, a plurality of cutting elements mounted at the surface of the leading face of the bit body, a passage in the bit body for supplying drilling fluid to a plurality of openings in the leading face of the bit body, and one or more junk slots in the gauge region of the bit body, whereby drilling fluid emerging from the openings flow over the leading face of the bit body and past the cutting elements thereon, so as to cool and clean the cutting elements before exiting through the junk slot. At least one of the openings is located in an area of the leading face adjacent the gauge region, and is angularly spaced from the nearest associated junk slot, the flow path between the opening and the junk slot being such that, in normal use of the bit, drilling fluid flowing from the opening to that junk slot flows substantially peripherally along an outer peripheral region of the leading face of the bit, adjacent the gauge region, so as to flow past cutting elements in that peripheral region.

29 Claims, 14 Drawing Figures

ROTARY DRILL BITS

BACKGROUND OF THE INVENTION

The invention relates to rotary drill bits for use in drilling deep holes in subsurface formations, and of the kind comprising a bit body having a leading face and a gauge region, a plurality of cutting elements mounted at the surface of the leading face of the bit body, a passage in the bit body for supplying drilling fluid to a plurality of openings in the leading face of the bit body, and at least one junk slot in the gauge region of the bit body, whereby drilling fluid emerging from said openings flows over the leading face of the bit body and past cutting elements thereon, so as to cool and clean the cutting elements before exiting through said junk slot.

The invention is particularly, but not exclusively, applicable to drill bits of this kind in which the cutting elements are in the form of preforms of polycrystalline diamond spaced apart over the leading face of the bit. Such preforms may be mounted directly on the bit body or mounted on studs which are received in sockets in the bit body. This invention relates, however, primarily to the cooling and cleaning of the cutting elements and is thus also applicable generally to bits using other types of shaped manufactured cutting elements.

The cutting elements will normally be spaced over the leading face of the bit at various distances from its axis of rotation, from positions close to the axis to positions close to the gauge region. Conventionally, the openings in the surface of the bit body to which drilling fluid is supplied are normally located fairly close to the axis of rotation of the bit so that drilling fluid emerging from the openings flows outwardly over all parts of the leading face of the bit to the junk slots at the outer periphery. In some cases, however, auxiliary openings may be provided at locations intermediate the axis of rotation and periphery to augment the flow of fluid across the outer parts of the bit. Channels may be formed in the leading face of the bit extending away from the axis of rotation thereof to direct the flow of drilling fluid. For example, the cutting elements may be mounted on blades extending away from the axis of rotation of the bit, the blades defining between them channels for the drilling fluid and the cutting elements being so mounted on the blades that fluid passing outwardly along the channels flows over the cutting elements so as to cool and clean them. The openings for drilling fluid in the surface of the bit are often in the form of nozzles inserted in sockets in the bit body.

The cooling and cleaning of the cutting elements by the drilling fluid is, in conventional bits of this type, most efficient in the vicinity of the openings which are in the region close to the axis of rotation of the bit. This is due to the high velocity of flow and turbulence of the drilling fluid as it emerges from the openings. The drilling fluid spreads out as it passes outwardly away from the axis of rotation of the bit, however, and its velocity and turbulence therefore decrease with the result that the cooling and cleaning effect of the fluid on the cutting elements located towards the outer periphery of the bit is greatly reduced. The less efficient cooling of the outer cutting elements, and the consequent higher temperatures to which they are thus submitted, can lead to early failure of these cutting elements, rendering the bit unusable for further drilling in spite of the fact that a large proportion of the cutting elements nearer the axis of rotation of the bit may still be in good condition.

The present invention therefore sets out to provide a drill bit construction in which the cooling and cleaning of cutting elements near the outer periphery of the drill bit is improved.

SUMMARY OF THE INVENTION

According to the invention a rotary drill bit for use in drilling deep holes in subsurface formations comprises a bit body having a leading face and a gauge region, a plurality of cutting elements mounted at the surface of the leading face of the bit body, a passage in the bit body for supplying drilling fluid to a plurality of openings in the leading face of the bit body, and at least one junk slot in the gauge region of the bit body, whereby drilling fluid emerging from said openings flows over the leading face of the bit body and past cutting elements thereon, so as to cool and clean the cutting elements before exiting through said junk slot, at least one of said openings being located in an area of the leading face adjacent the gauge region, and being angularly spaced from the nearest associated junk slot, the flow path between said opening and junk slot being such that, in normal use of the bit, drilling fluid flowing from the opening to that junk slot flows substantially tangentially along an outer peripheral region of the leading face of the bit, adjacent the gauge region, so as to flow past cutting elements in said peripheral region.

By an associated junk slot is meant a junk slot which is intended, during normal operation of the drill bit, to receive a substantial proportion of the flow from the associated opening. In some bit designs a junk slot which is physically close to an opening may not, in fact, receive a significant proportion of the flow from that opening due to the configuration of the intervening surface of the bit. For example, the intervening surface may include fences or blades which permit the passage of only a small leakage flow from the opening to the junk slot. In such a case, the junk slot is not regarded as being associated with the opening.

Although some arrangements are already known in which openings for drilling fluids are provided adjacent the gauge region of a drill bit, in the known arrangements the relative dispositions of these outer openings and the junk slots, and also the arrangement of the cutting elements on the bit body, are not such as to provide the tangential flow along the periphery provided by the present invention. For example, U.S. Pat. No. 3,215,215 shows an arrangement having nozzles located adjacent the periphery of a drill bit, but in this case the flow from each nozzle passes radially inwards towards the axis of rotation of the bit and radially outwards to an adjacent junk slot and does not promote flow of drilling fluid in the peripheral direction. In International Pat. No. WO 84/00186 there are again described arrangements in which nozzles are provided adjacent the gauge region of a drill bit, but in this case the arrangement is such that drilling fluid emerging from the nozzles flows inwardly towards the axis of rotation of the drill bit before flowing outwardly again to junk slots in the gauge region. There is thus no substantial peripheral flow from the nozzles.

With the arrangement according to the present invention the turbulent and high velocity flow from the nozzles adjacent the gauge region of the bit will extend across a large part of the outer peripheral region of the leading face of the bit on its way to the nearest junk slot.

The cutting elements which lie in that part of the flow will therefore be efficiently cooled and cleaned.

In order to provide a useful length of flow path between each opening and its nearest associated junk slot, the angular separation of the opening from the junk slot is preferably not less than 40°.

The shortest distance between the opening and the gauge region, measured over the leading surface of the bit, may be less than 1/6 of the diameter of the bit body at the gauge region and is preferably less than ⅛ of said diameter. In some cases it may be preferable for the shortest distance to be less than 1/10 of the diameter of the bit body at the gauge portion.

Alternatively or additionally, the shortest distance between the opening and the gauge region, measured over the leading surface of the bit, may be less than ½ of the shortest distance between the opening and said nearest associated junk slot, and is preferably less than ⅓ of said distance. In some cases it may be preferable for the shortest distance between the opening and the gauge region to be less than ¼ of its shortest distance from said junk slot.

In one embodiment according to the invention there may be provided a plurality of openings spaced apart substantially symmetrically around an outer peripheral area of the leading face of the bit body, and a plurality of junk slots spaced apart substantially symmetrically around the gauge region. In this case each said opening is preferably located substantially equidistantly between two junk slots. For example, there may be provided two substantially diametrically opposed openings and two substantially diametrically opposed junk slots arranged symmetrically with respect to the openings.

In an alternative embodiment there may be provided three openings angularly spaced apart by substantially 120°, and three junk slots also spaced apart by substantially 120°. In this case also each opening is prefarably located substantially equidistantly between two junk slots.

In any of the arrangements according to the invention, there is preferably provided at least one opening spaced radially inwardly of said outer peripheral area of the leading face of the bit body. Thus, further openings or nozzles may be located in any conventional arrangement in the vicinity of the axis of rotation of the drill bit, or intermediate the axis of rotation and the gauge region.

There may be provided on the surface of the bit body a plurality of blades extending outwardly with respect to the axis of rotation of the bit, cutting elements being mounted on said blades.

In this case, the outer extremities of at least certain of the blades may extend across the path of flow from a peripheral opening to its nearest junk slot, whereby, in use, drilling fluid flows transversely across said outer extremities of the blades.

In another specific embodiment according to the invention, substantially all of the openings in the leading face of the bit body lie on the opposite side of a diameter of the bit body to substantially all of the junk slots. There may be provided, in such an arrangement, a plurality of junk slots arranged side-by-side around a portion of the gauge region, or only a single junk slot. In such an arrangement, preferably substantially all the openings are located in an area of the leading face of the bit body adjacent the gauge region.

The last mentioned arrangement provides the advantages of the invention since flow from at least certain of the openings will flow around peripheral regions of the leading face of the bit body as it passes to the junk slot or slots. However, the disposition of the openings and junk slots on opposite sides of a diameter of the bit also provides a further advantage. It is sometimes required to change by a few degrees the direction of a hole being drilled. For example, it is normal for a first portion of a hole to be vertical before continuing with the hole at a small angle to the vertical. Various methods are used to initiate the change of angle of the hole being drilled. However, one method, which is sometimes used with tri-cone roller cone bits, comprises providing the bit with only one assymetrically disposed nozzle for drilling fluid, the other two nozzle positions normally provided being blanked off. At the depth selected for change of drilling angle, rotation of the bit is stopped and the bit is moved up and down in the last few feet of the hole while drilling fluid is pumped through the single nozzle, the bit being suitably orientated according to the required direction of the change of angle. The fluid being pumped through the single nozzles erodes one side of the hole. This process is repeated every few feet until a few degrees of angle (which may be as little as one or two degrees) have been built up. From then on, a conventional angle building assembly can be used controlled by weight on the bit.

A bit of the kind last described, therefore, in which most or all the openings for drilling fluid are on one side of the bit, may be used in the manner just described to initiate a change in the angle of the hole being drilled by stopping rotation of the bit in the appropriate orientation and pumping drilling fluid through the openings.

In the last described arrangement according to the invention, means may be provided to define flow channels in the leading face of the bit body extending from each opening at one side of the bit to an associated junk slot at the opposite side of the bit. Such channels may be defined by blades on which the cutting elements are mounted and/or by fences extending across the surface of the leading face of the bit. The cutting elements may be mounted on the blades and/or in the channels themselves. The provision of such channels may improve cleaning of the cutting elements since in the event of a partial blockage in one of the channels, the pressure across the blockage will rise and the velocity near the partial blockage will tend to clear the blockage by erosion and/or pressure difference.

In any of the arrangements according to the invention, each cutting element may be of the known kind comprising a preform having a thin hard facing layer of superhard material, such as polycrystalline diamond, bonded to a less hard backing layer. Alternatively, each cutting element may comprises a preformed unitary layer of thermally stable polycrystalline diamond material bonded to the material of the bit body or to a stud inserted in a socket in the bit body. Alternatively, the thermally stable cutting element may be cast into a matrix bit body, with or without a cast in back support of comparatively rigid material.

DETAILED DESCRIPTION OF THE PREFERRED EMBODIMENTS

Figure 1:
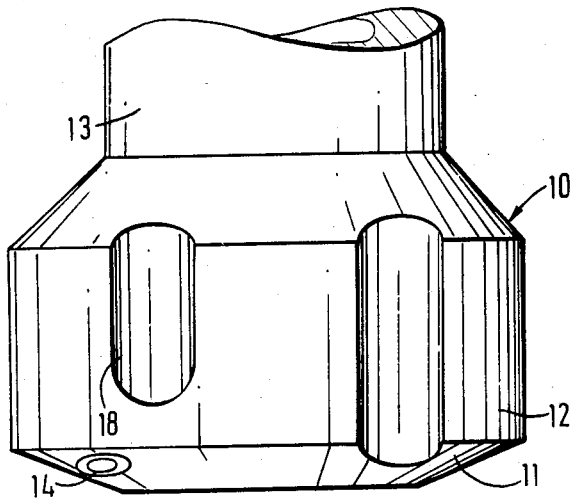
FIG. 1 is a diagrammatic side elevation of a drill bit in accordance with the invention.
Figure 2:
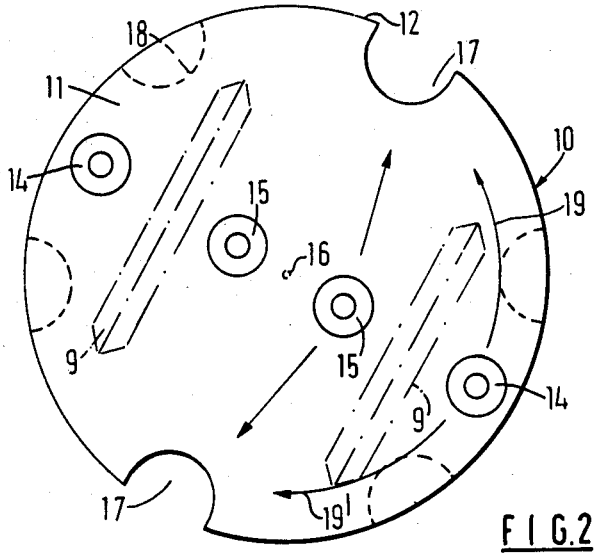
FIG. 2 is a diagrammatic end view of the drill bit shown in FIG. 1, FIGS. 3 and 4 are similar views to FIGS. 1 and 2 of an alternative form of drill bit.

Referring to FIGS. 1 and 2, there is shown a rotary drill bit for use in drilling deep holes in subsurface formations, comprising a bit body 10 having a leading face 11 and a trailing gauge region 12. Cutting elements are mounted over the surface of the leading face of the bit body. The precise nature of the cutting elements and their disposition and mounting on the leading face of the bit body do not form an essential part of the present invention and the cutting elements are not therefore shown in FIGS. 1 and 2. It will be appreciated that the invention is applicable to drill bits employing any type of cutting elements, such as preforms of polycrystalline diamond or other types of shaped manufactured cutting elements arranged in any configuration over the leading face of the drill bit.

The bit body 10 is formed with a shank 13 for connection of the bit to the drill string and the shank 13 and bit body 10 are formed with an internal passage (not shown) which supplies drilling fluid to openings in the leading face of the bit body. The gauge portion 12 of the bit body is formed with junk slots and the arrangement is such that, in use, drilling fluid emerges from the openings in the surface of the bit and flows across the leading face of the bit body to the junk slots, thus cooling and/or cleaning the cutting elements past which it flows.

As previously explained, in conventional drill bits of this kind, the openings for drilling fluid, which may be in the form of nozzles inserted in sockets formed in the material of the bit body, are normally located in the vicinity of the central axis of rotation of the drill bit, or intermediate that central axis and the gauge region. According to the invention, however, in the arrangement shown in FIGS. 1 and 2 there are provided two peripheral nozzles 14 which are diametrically opposed and are located in an area of the leading face 11 of the drill bit adjacent the gauge region 12. Two further nozzles 15 are located on the same diameter as the nozzles 14, but nearer the central axis 16 of the drill bit.

The gauge region 12 of the bit is formed with two junk slots 17 which are diametrically opposed and symmetrically spaced with respect to the nozzles 14. The gauge region is also formed with relief slots 18 which do not, however, extend into the leading face 11 of the drill bit and to not therefore consitute junk slots.

In operation of the drill bit, drilling fluid emerging from the nozzles 15 nearer the axis 16 flows outwardly across the face of the bit to the junk slots 17 in the conventional manner so as to cool and clean the cutting elements in the region between the nozzles and junk slots. However, due to the relative locations of the peripheral nozzles 14 and the junk slots 17, flow from these nozzles passes mainly tangentially along an outer peripheral region of the leading face 11 of the bit, adjacent the gauge region, as indicated by the arrows 19. Since it is the flow in the vicinity of a nozzle which is the most turbulent and has the highest velocity, locating the nozzles 14 adjacent the periphery and a significant distance from the nearest junk slots ensures that the fastest, most turbulent region of flow extends over cutting elements which are located in the peripheral region and provides efficient cooling and cleaning of these elements. The cooling and cleaning is thus more efficient than would be the case if, as in conventional drill bits, the nozzles 14 were located near the axis of rotation of the bit and more junk slots were provided in the gauge region.

To assist in restricting the flow from the nozzles 14 to the tangential direction, elongate fences may be provided on the surface of the drill bit radially inwardly of each nozzle 14, as indicated in chain lines at 9 in FIG. 2. Although, in FIG. 2, two nozzles 15 are shown in the vicinity of the central axis 16 of the bit, any suitable number and arrangement of these nozzles may be employed. For example, there may be provided only a single nozzle 15.

Figure 3:
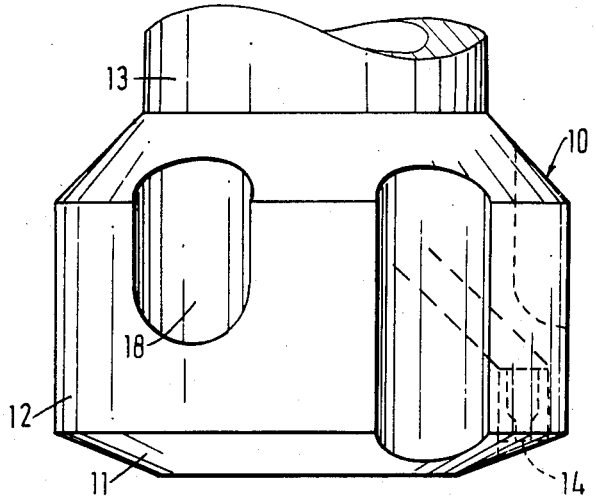
Figure 4:
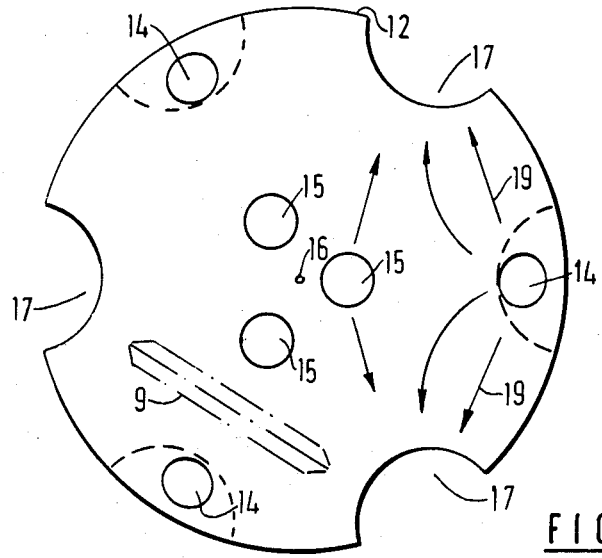

In the alternative arrangement shown in FIGS. 3 and 4 there are provided three peripheral nozzles 14 equally spaced at 120° and, similarly, three equally spaced junk slots 17. Again, flow from each nozzle 14 is forced to flow across an outer peripheral region of the leading face of the drill bit in order to reach the nearest junk slot. The flow may, as in the FIG. 2 arrangement, be restricted to the tangential direction by fences inwardly of the nozzles 14, one of such fences being indicated in chain lines at 9 in FIG. 4.

Figure 5:
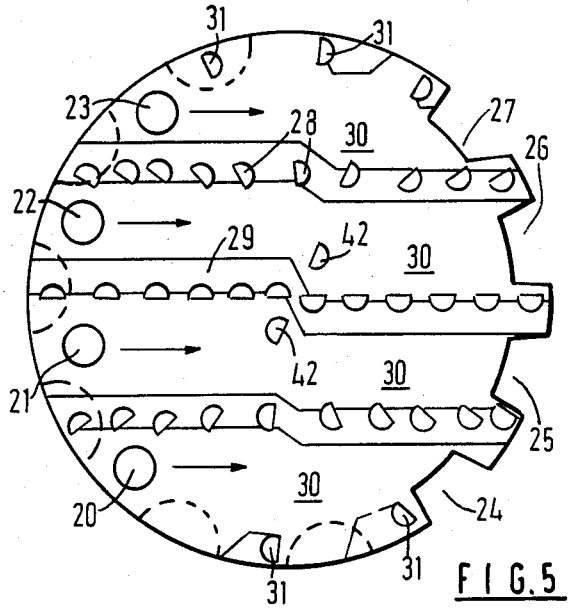
FIGS. 5 and 6 are end views of further forms of drill bit.
Figure 5A:
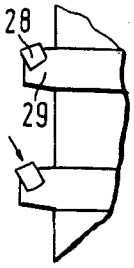
FIG. 5*a* is a scrap section of a part of the bit shown in FIG. 5.

In the alternative arrangement shown in FIG. 5 there are provided four nozzles 20, 21, 22 and 23 and four junk slots 24, 25, 26 and 27, the nozzles and junk slots being grouped together side-by-side on opposite sides of a diameter of the bit. In this arrangement the cutting elements 28 are mounted on blades 29 formed on the leading face of the bit so as to define channels 30 between the blades. In addition further cutting elements 31 are mounted around the periphery of the leading face of the bit, and elements 42 are provided near the centre of the bit.

Each cutting element faces in a direction having a component into the associated channel 30 and is therefore cooled and cleaned by the drilling fluid flowing from the nozzle along the channel to its associated junk slot. In the case of the two outer nozzles 20 and 23, the path of flow of drilling fluid from these nozzles to their associated junk slots 24 and 27 respectively passes tangentially along opposite outer peripheral regions of the leading face of the bit so as to cool and clean the peripheral cutting elements 31.

The arrangement shown in FIG. 5 is by way of example only and the number and disposition of the nozzles and/or junk slots may be varied. For example, only a single junk slot might be provided. Although in the arrangement shown the channels 30 are defined by the blades 29 on which the cutting elements 28 are mounted, the channels might also be defined partly or wholly by fences on the surface of the bit, and in this case some or all of the cutting elements may be mounted within the channels 30 defined by the fences. Such an arrangement is shown in FIG. 7 in which the fences are indicated at 29*a*.

Figure 6:
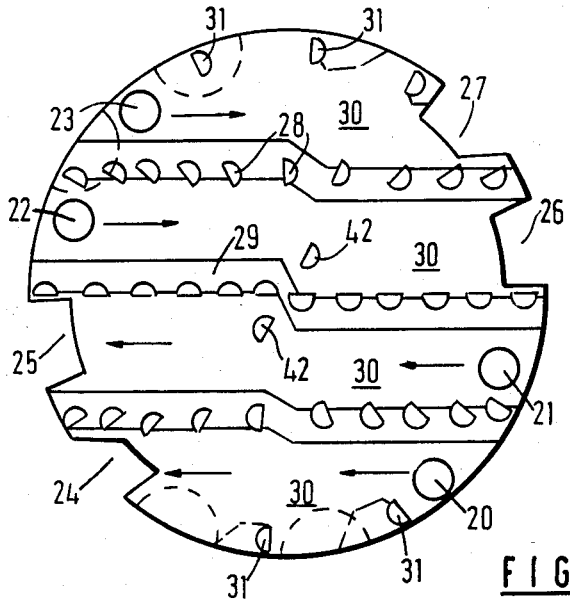

In the modified arrangement of FIG. 6 the positions of two of the nozzles, 20 and 21, and their respective associated junk slots 24 and 25 are interchanged. This has the advantage that the cutting elements on the blades 29 furthest from the axis of rotation of the bit all face at least partly towards the flow from the nozzles, so as to optimise the cooling and cleaning effect of the flow of drilling fluid.

Figure 7:
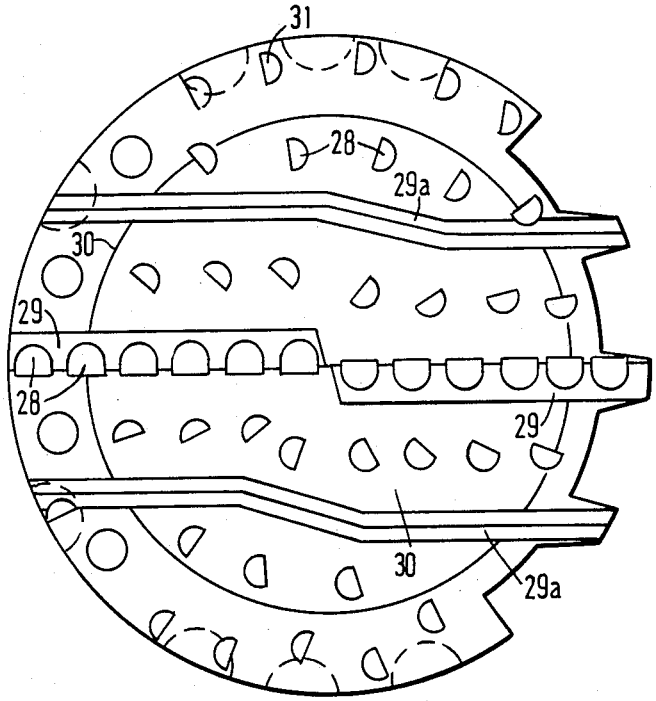
FIG. 7 shows a modified form of the drill bit of FIG. 5.

The provision of the channels 30 in the arrangements of FIGS. 5 to 7 maintains a restricted flow path from each nozzle to its associated junk slot with only limited cross-channel leakage. If total or partial blockage of any channel with drilling debris should occur, this will cause a high pressure difference across the blockage since the fluid passing into the channel from the nozzle cannot divert to an alternative flow path. Consequently, the high pressure difference will tend to clear the blockage. In the case of a partial, or partially cleared, blockage of the channel, the flow path past the blockage will be restricted, leading to increase in velocity of the flow and consequent erosion of the blockage by the drilling fluid flowing past it. Channel arrangements such as those shown in FIGS. 5 to 7 thus reduce the risk of cutter failure through lack of cooling and cleaning due to blockage of the flow of drilling fluid.

As previously described the assymetric arrangements of the kind shown in FIGS. 5 and 7 may also be used for initiating a change in the angle of a hole being drilled.

Figure 8:
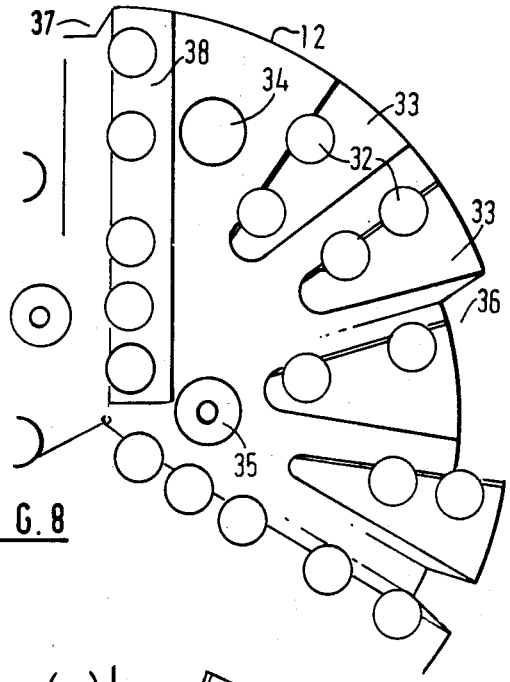
FIG. 8 is a partial end view of a still further form of drill bit according to the invention in which the cutting elements are mounted on blades on the bit body.
Figure 9:
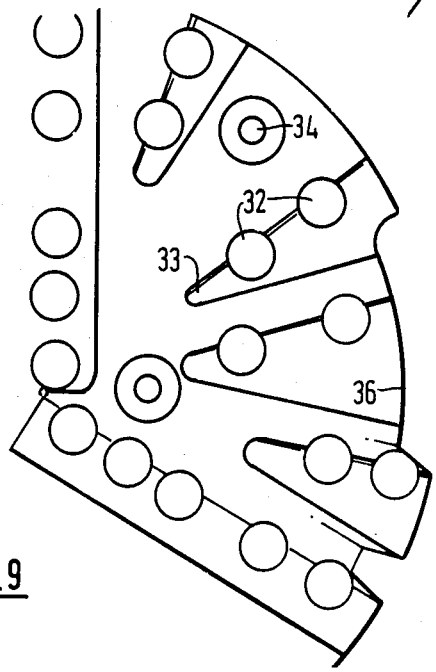
FIGS. 9 to 13 are similar views to FIG. 8 of alternative arrangements in accordance with the invention.
Figure 10:
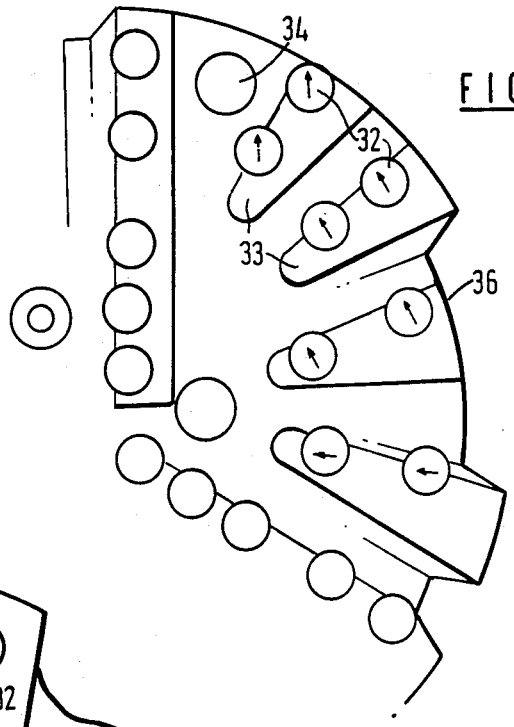
Figure 11:
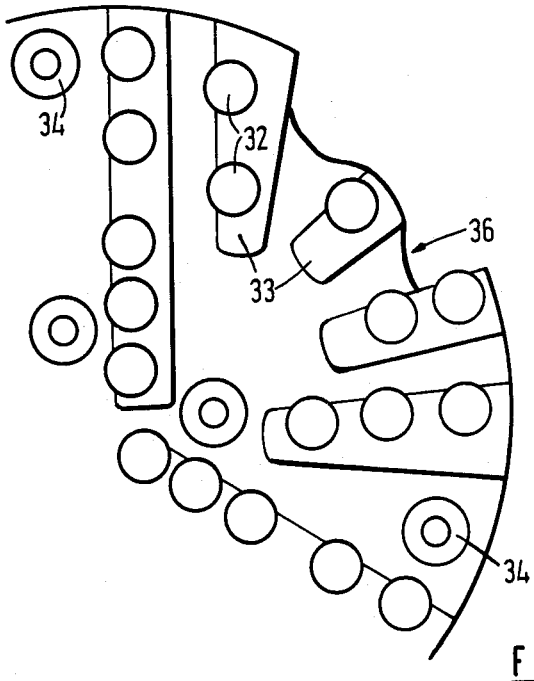
Figure 12:
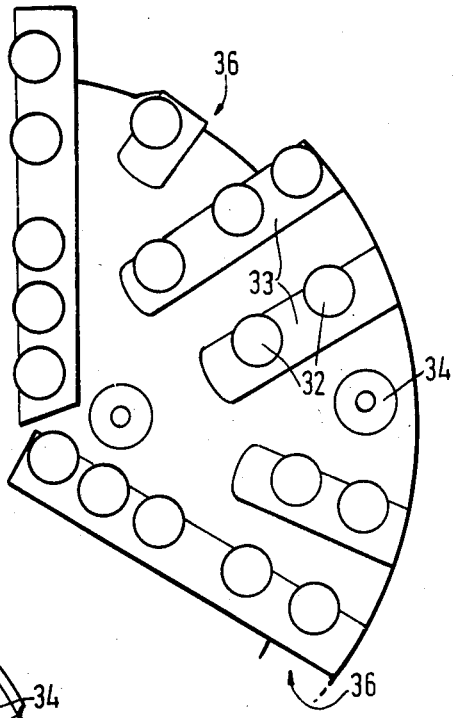
Figure 13:
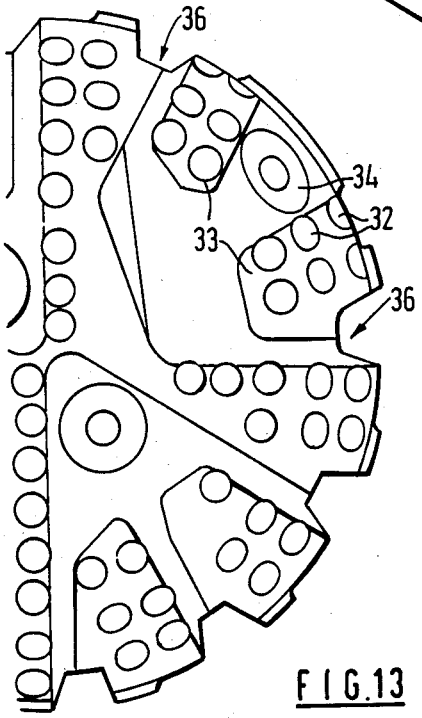

As previously mentioned, any conventional arrangement may be employed for the cutting elements, and FIG. 8 shows an arrangement in which cutting elements indicated diagrammatically at 32 are mounted on blades 33 which extend in a generally radial direction so as to provide channels for drilling fluid between the blades. In the arrangement shown in FIG. 8 there are provided nozzles 34 close to the gauge region 12 of the bit as well as nozzles 35 nearer the central axis of rotation of the bit. As in the previously described arrangements, the junk slots, such as is indicated at 36, are so located in relation to the peripheral nozzles 34 that drilling fluid passing from each nozzle 34 to an associated junk slot 36 flows across the outer peripheral region of the leading face of the bit between the junk slot and the nozzle. Thus, in the arrangement shown in FIG. 8, this peripheral flow will pass over at least the outer extremities of the blades 33 which lie between the nozzle 34 and junk slot 36, and the blades are configured to permit such flow.

It will be seen that the arrangement of FIG. 8 incorporates a further junk slot 37 which is, physically, nearer the peripheral nozzle 34 than the junk slot 36. However, the blade 38 carrying cutting elements adjacent the nozzle 34 provides less clearance between it and the formation than the blades 33, so that, in normal use of the bit, there will be less flow of drilling fluid from the nozzle 34 to the junk slot 37 and a major portion of flow from the nozzle 34 will be across the blades 33 to the junk slot 36.

FIGS. 9 to 13 show diagrammatically alternative configurations where, in each case, flow from a peripheral nozzle 34 to the associated junk slots 36 takes place across outer peripheral regions of the leading face of the bit so as effectively to cool and clean the cutting elements in those regions. In each case there may be some flow from the peripheral nozzle in other directions, but the major proportion of the flow is in the peripheral region.

In an alternative arrangement, not shown, there may be associated with each peripheral nozzle and its associated junk slot a fence which extends in a peripheral direction radially inwardly of the outer periphery of the bit, so as to define between the fence and the gauge region a peripheral channel which provides a direct restricted flow path from the nozzle to the junk slot, cutting elements being mounted in the channel or facing at least partly into the channel.

In any arrangements according to the invention in which fences are provided on the surface of the bit body to provide flow paths for the drilling fluid, such fences may be resilient or in the form of brushes as described in British Patent specification No. 2,148,978.

Arrangements according to the present invention may also have the advantage that the drill bit is particularly suitable for reaming operations where only cutters adjacent the periphery of the bit act on the formation. Conventional drill bits, where the hydraulics systems are designed for effectiveness in ordinary drilling, will not generally give good reaming performance due to inadequate cooling and cleaning of the peripheral cutting elements.

In a number of the arrangements described above, the drill bit is provided with additional nozzles for drilling fluid spaced radially inwardly of the peripheral nozzles provided in accordance with the invention. In such cases, the flow area provided by the peripheral nozzles is preferably not less than half of the total flow area provided by all the nozzles.

What is claimed is:

1. A rotary drill bit for use in drilling holes in subsurface formations comprising a bit body having a leading face and a gauge region, cutting elements mounted at the surface of the leading face of the bit body, a passage in the bit body for supplying drilling fluid to a plurality of openings in the leading face of the bit body, and at least one junk slot in the gauge region of the bit body associated with each such opening in that the leading face of the bit body provides at least one flow path from said opening to the associated junk slot, whereby drilling fluid emerging from said openings flows over the leading face of the bit body and past cutting elements thereon, so as to cool and clean the cutting elements before exiting through said junk slot, at least one of said openings being a peripheral opening located in an area of the leading face adjacent the gauge region, said peripheral opening being angularly spaced from the nearest associated junk slot, and the shortest distance between said opening and the gauge region, measured over the leading surface of the bit being less than ½ of the shortest distance between said opening and said nearest associated junk slot, whereby said one flow path between said peripheral opening and said nearest associated junk slot extends mainly peripherally along the outer peripheral region of the leading face of the bit, adjacent the gauge region, said one flow path offering less resistance to fluid flow than any path extending mainly radially outwardly from said peripheral opening to the gauge region, and wherein a plurality of said cutting elements are disposed generally in said one flow path from said peripheral opening to said nearest associated junk slot so that fluid in said one flow path flows peripherally past said plurality of cutting elements in said peripheral region.

2. A drill bit according to claim 1, wherein such openings located in an area of the leading face adjacent the gauge region provide not less than half of the total flow area provided by all the openings in the leading face of the bit body.

3. A drill bit according to claim 1, wherein each cutting element comprises a preform having a thin hard facing layer of superhard material bonded to a less hard backing layer.

4. A drill bit according to claim 1, wherein each cutting element comprises a preformed unitary layer of thermally stable polycrystalline diamond material.

5. A drill bit according to claim 4, wherein each thermally stable cutting element is cast into a matrix bit body.

6. A drill bit according to claim 1, wherein the angular separation of said peripheral opening from said nearest associated junk slot is not less than 40°.

7. A drill bit according to claim 1, wherein the shortest distance between the peripheral opening and the gauge region, measured over the leading surface of the bit, is less than 1/6 of the diameter of the bit body at the gauge region.

8. A drill bit according to claim 7, wherein the shortest distance between the peripheral opening and the gauge region, measured over the leading surface of the bit, is less than $\frac{1}{8}$ of the diameter of the bit body at the gauge region.

9. A drill bit according to claim 8, wherein the shortest distance between the peripheral opening and the gauge region, measured over the leading surface of the bit, is less than 1/10 of the diameter of the bit body at the gauge region.

10. A drill bit according to claim 1, wherein the shortest distance between the peripheral opening and the gauge region, measured over the leading surface of the bit, is less than $\frac{1}{3}$ of the shortest distance between the peripheral opening and said nearest associated junk slot.

11. A drill bit according to claim 1, wherein the shortest distance between the peripheral opening and the gauge region, measured over the leading surface of the bit, is less than $\frac{1}{4}$ of the shortest distance between the peripheral opening and said nearest associated junk slot.

12. A drill bit according to claim 1, wherein there is provided a plurality of such peripheral openings spaced apart substantially symmetrically around an outer peripheral area of the leading face of the bit body, and a plurality of junk slots spaced apart substantially symmetrically around the gauge region, said leading face of said bit body providing a respective such flow path from each of said peripheral openings to at least one of said junk slots.

13. A drill bit according to claim 12, wherein each of said peripheral openings is located substantially equidistantly between two junk slots, said leading face of said bit body providing two said flow paths from said opening to said two junk slots respectively.

14. A drill bit according to claim 13, wherein there are provided two substantially diametrically opposed peripheral openings and two substantially diametrically opposed junk slots arranged symmetrically with respect to the openings.

15. A drill bit according to claim 12, wherein there are provided three peripheral openings angularly spaced apart by substantially 120°, and three junk slots also spaced apart by substantially 120°.

16. A drill bit according to claim 1, wherein there is provided at least one opening spaced radially inwardly of said outer peripheral area of the leading face of the bit body.

17. A drill bit according to claim 1, wherein there is provided on the surface of the bit body a plurality of blades extending outwardly with respect to the axis of rotation of the bit, cutting elements being mounted on said blades.

18. A drill bit according to claim 17, wherein the outer extremities of at least certain of the blades extend across the path of flow from a peripheral opening to its nearest junk slot, whereby, in use, drilling fluid flows transversely across said outer extremities of the blades.

19. A drill bit according to claim 1 wherein the shortest distance between said peripheral opening and the gauge region, measured over the leading surface of the bit, is less than 1/6 of the diameter of the bit body at the gauge region, and the opening being angularly spaced by not less than 40° from the nearest associated junk slot, whereby the flow path between said opening and junk slot is such that, in normal use of the bit, drilling fluid flowing from the opening to that junk slot flows substantially peripherally along an outer peripheral region of the leading face of the bit, adjacent the gauge region, so as to flow past cutting elements in said peripheral region.

20. A drill bit according to claim 1 wherein said one flow path between said peripheral opening and said nearest associated junk slot is a main flow path offering less resistance to fluid flow than any other path from said peripheral opening along said leading face to said nearest associated junk slot or to any other exit passage.

21. A drill bit according to claim 20 wherein at least some of said plurality of cutting elements in said one flow path from said peripheral opening to said nearest associated junk slot are angularly spaced from each other.

22. A drill bit according to claim 21 wherein each cutting element comprises a preformed layer of polycrystalline diamond material.

23. A rotary drill bit for use in drilling holes in subsurface formations comprising a bit body having a leading face and a gauge region, a plurality of cutting elements mounted at the surface of the leading face of the bit body, a passage in the bit body for supplying drilling fluid to a plurality of openings in the leading face of the bit body, and at least one junk slot in the gauge region of the bit body, whereby drilling fluid emerging from said openings flows over the leading face of the bit body and past the cutting elements thereon, so as to cool and clean the cutting elements before exiting through said junk slot, at least one of said openings being a peripheral opening located in an area of the leading face adjacent the gauge region, said peripheral opening being angularly spaced from the nearest associated junk slot, and the shortest distance between said opening and the gauge region, measured over the leading surface of the bit, being less than $\frac{1}{2}$ of the shortest distance between said opening and said nearest associated junk slot, whereby the flow path between said peripheral opening and junk slot is such that, in normal use of the bit, drilling fluid flowing from the opening to that junk slot flows substantially peripherally along the outer peripheral region of the leading face of the bit, adjacent the gauge region so as to flow past cutting elements in said peripheral region, wherein substantially all of the openings in the leading face of the bit body lie on the opposite side of a diameter of the bit body to substantially all of the junk slots.

24. A drill bit according to claim 23, wherein there is provided a plurality of junk slots arranged side-by-side around a portion of the gauge region.

25. A drill bit according to claim 24, wherein substantially all the openings are located in an area of the leading face of the bit body adjacent the gauge region.

26. A drill bit according to claim 23, wherein means are provided to define flow channels in the leading face of the bit body extending from each opening at one side of the bit to an associated junk slot at the opposite side of the bit.

27. A drill bit according to claim 26, wherein said channels are defined by blades on which the cutting elements are mounted.

28. A drill bit according to claim 26, wherein said channels are defined by fences extending across the surface of the leading face of the bit.

29. A drill bit according to claim 28, wherein the cutting elements are mounted in said channels.

* * * * *

UNITED STATES PATENT AND TRADEMARK OFFICE

CERTIFICATE OF CORRECTION

PATENT NO. : 4,697,654

DATED : October 6, 1987

INVENTOR(S) : John D. Barr; Malcolm R. Taylor

It is certified that error appears in the above-identified patent and that said Letters Patent is hereby corrected as shown below:

In Column 10, line 11, add --slot--.

In Column 10, delete lines 12 - 18.

Signed and Sealed this

Tenth Day of May, 1988

*Attest:*

*Attesting Officer*

DONALD J. QUIGG

*Commissioner of Patents and Trademarks*